United States Patent [19]

Gregory et al.

[11] Patent Number: 4,769,937

[45] Date of Patent: Sep. 13, 1988

[54] RECOIL REDUCTION DEVICE INCLUDING MEANS FOR ADJUSTING THE STOCK LENGTH OF SHOTGUNS

[76] Inventors: Glenn D. Gregory, 5059 San Aquario Dr., San Diego, Calif. 92109; Wayne E. Gilbert, 12919 Corte Juana, Poway, Calif. 92064

[21] Appl. No.: 101,072

[22] Filed: Sep. 25, 1987

[51] Int. Cl.[4] ..... F41C 23/00

[52] U.S. Cl. ..... 42/74

[58] Field of Search ..... 42/1.06, 74

[56] References Cited

U.S. PATENT DOCUMENTS 480,587 8/1892 Jones et al. .
544,269 8/1895 Winters .
887,601 12/1906 Behr .
2,455,438 12/1948 Oppold ..... 42/74
3,039,222 6/1962 Hoge ..... 42/74
3,233,354 2/1966 Ahearn ..... 42/74

OTHER PUBLICATIONS

Scherer, E., "Kolar Koil-The Ultimate Recoil Reducer", *Shotgun Sports* Feb. 1984.

*Primary Examiner*—Ted L. Parr
*Attorney, Agent, or Firm*—Bruno J. Verbeck

[57] ABSTRACT

A pneumatic recoil reduction device for a shotgun. The device, fitted into a cavity in the butt end of a shotgun, has an air cylinder equipped with a valved hole, or port, which is located in the end of the air cylinder, closest to the butt end of the shotgun. This permits adjusting the pressure in the air cylinder from the rear without disassemblying the butt stock.

11 Claims, 2 Drawing Sheets

RECOIL REDUCTION DEVICE INCLUDING MEANS FOR ADJUSTING THE STOCK LENGTH OF SHOTGUNS

TECHNICAL FIELD

The present invention relates to a novel pneumatic recoil reduction device for shotguns including means combined therewith for filling the device with air and for adjusting the length of the stock of the shotgun.

There are several types of pneumatic recoil reduction devices for shotguns of which applicants are aware. One such is based, generally, on the pneumatic recoil reduction device which is disclosed in U.S. Pat. No. 3,039,222, issued June 19, 1962 to Ralph O. Hoge. That device, which is positioned and mounted within a recess, or socket, in the stock, is, as disclosed in that patent, in the form of a metal plug, and an extension thereof. The plug is bored to provide compressed air cylinders, while flanged elements of the plug hold the plug, by means of screws, to the outer end of the stock. A lateral opening in the stock communicates with a cylinder in the recess, and a conventional air valve is disposed in that lateral opening, and appropriately connected to a compressed air cylinder. The valve opening and valve are covered by a cheek protector, which must be removed to permit access to the valve. The cheek protector, or plate is recessed to receive elements of the recoil-absorbing device, and has a standard butt plate screw-connected thereto. Pistons carried in the air-compression cylinders are connected to piston rods, whose outer ends are secured to a plate housed in the aforesaid recess of the cheek protector, that plate being secured to the butt plate. The outer end of each cylinder is fitted with a piston rod bushing to assist in keeping the various members in alignment, and the pistons are equipped with sealing rings to prevent air leakage. The patent does not disclose any means for adjusting the length of the gun stock and, in particular, no such means combined with elements of the recoil reduction device itself.

The other type of device is a pneumatic recoil device which was produced by the Kolar Company of Racine, Wisconsin and is further described in "Shotgun Sports" for February 1984, published by Frank Kodl, P.O. Box 340, Lake Havasu City, Ariz. 86403. That device is installed in the butt stock either with or without a sleeve or boot thereover.

With none of the prior art devices of which applicants are aware, is it possible to fill or adjust the air pressure, in the air cylinder, from the rear, that is through a hole or port located at the rear of the butt stock, nor is there disclosed, or taught by any of these prior art devices, any means for adjusting the length of the stock. Furthermore, those devices have a tendency to cause some aberration in firing accuracy stemming from "binding" of moving parts, due, in particular, to the kind of guide rods used.

DISCLOSURE OF THE INVENTION

One object of the invention is to provide an improved pneumatic recoil reduction device for shotguns which is an improvement over the pneumatic recoil reduction devices previously used.

Another object is to provide a method of easily adjusting the air pressure of the device, to reach various recoil or comfort levels, by filling, or adjusting the air pressure, of the device through the rear of the stock, i.e. the butt end of the shotgun stock, without disassembling the butt stock, which can be done at the shooting range or in the field. Another object is to provide such a device which is combined with means for adjusting the length of the butt stock without removing the device from the butt stock, or letting the air out of the unit, thus permitting adjustment of the length at the shooting range where an air compressor may not be available. Our length adjustment means differs from previous devices in that ours permits adjustment of butt stock length without its removal from the stock, or without refilling with air. A further object is to improve the operability of the device by incorporating therewithin flexible self-lubricating guide rods in place of previously used rigid steel guide rods. The latter would frequently bind during collapse of the device during recoil, making it partially or totally inoperable or ineffective as a recoil device. Such binding often occurs when the shooter "cheeks" the shotgun hard (many shooters press their cheek tightly downward on the upper portion of the stock when shooting). Such also occurs frequently if the rear of the stock (i.e. the sleeve or boot in the device disclosed, for example in the Hoge U.S. Pat. No. 3,039,222) is not perfectly aligned. Misalignment can also occur due to production tolerances, poor installation, or swelling of the sleeve or boot in high humidity environments. Applicants' invention posseses advantages over the prior art at least in the following respects:

(1) the ability to fill or empty the cylinder through the rear butt pad or butt plate, without disassembling the butt stock. A sleeve or boot, if used, to partially telescope over the butt stock during firing of the shotgun would not have to be removed, thereby allowing the shooter to effect such adjustment with an ordinary tire pump, at a service station, with a home compressor, or anywhere that compressed air is available, and furthermore requires no other tools or equipment to effect such;

(2) length adjustment means allows the shooter to adjust the shotgun to fit his or her arm length, to adjust for the wearing of different thickness of clothing, or for his or her other personal preference or desires, without removal of the adjusting means from the butt stock. This can be done in the field or at the shooting range, since the device does not have to be deflated and then reinflated. Lengthening or shortening a typical butt stock is usually permanent, expensive, and usually lacking in asthetics. Our improvement eliminates these problems and the necessity of, for example, leaving the shotgun with a gunsmith for a period of time. In the present invention the length adjustment can be accomplished in a matter of minutes;

(3) the flexible guide rods and the improved bushing, as more fully described hereinafter, virtually eliminate binding of the device during recoil. This is important because any such binding renders the device partially or completely ineffective as a recoil reduction device.

These and other objects and advantages of our invention will become apparent from the following detailed description, taken in conjunction with the accompanying drawings.

BEST MODE FOR CARRYING OUT THE INVENTION

The following is a description of the best mode presently known to applicants for carrying out their invention.

Figure 1:
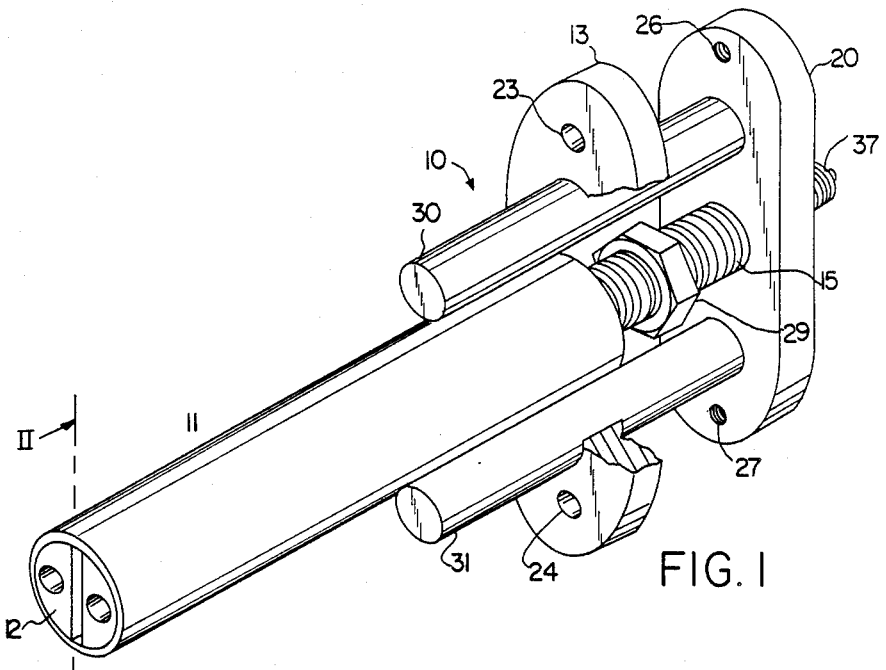
FIG. 1 is a view in perspective of the recoil reduction device of the invention.

FIG. 1 illustrates in perspective the recoil reduction device 10 of the invention. Housing 11 is in the form of a tube of an aluminum alloy having a plug 12 of metal or plastic threadably connected to the housing 11, and equipped with a neoprene "O" ring 12a to provide an air-tight seal therewithin. The opposite end of housing 11 has an apertured end plate 13 secured thereto. A bushing 14 (not shown in FIG. 1) and preferably formed of a plastic such as Delrin 500AF, an acetal resin having an extremely low coefficient of friction, manufactured by the DuPont Company, is also securely fitted to the end of housing 11.

Figure 2:
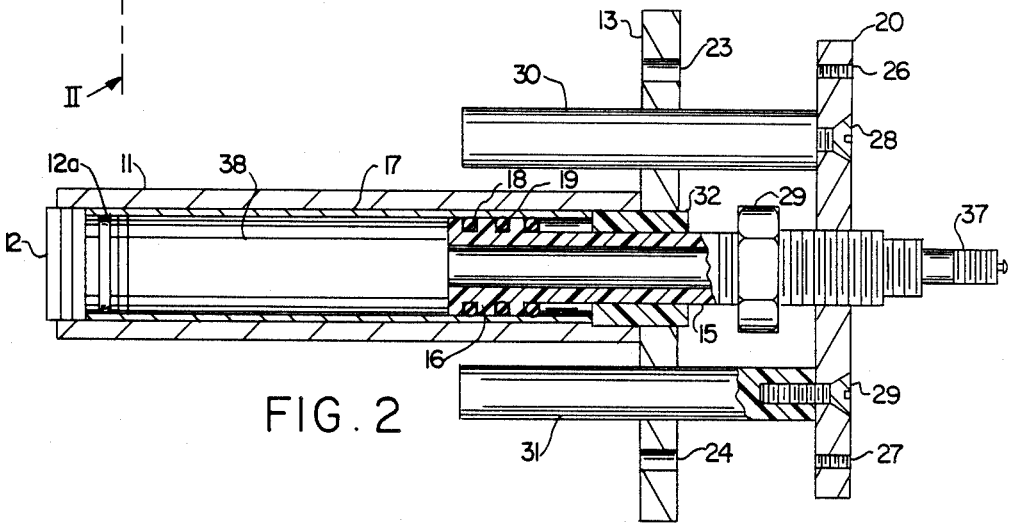
FIG. 2 is a vertical section through the device of FIG. 1 taken generally through the line II—II of FIG. 1.

As best shown in FIG. 2, a threaded hollow piston rod 15 which is connected to piston 16 for passage of air therethrough, passes through end plate 13, then threadably through end plate 20, and terminates in a valved member 37. Piston 16 and piston rod 15 are positioned within a stainless steel sleeve 17 in an airtight manner, for movement therewithin, the sleeve 17 being in close fitting relationship with the interior surfaces of the tube forming.a cylinder which comprises housing 11. Piston 16 is grooved at 18 and 19, with the grooves having neoprene "O" rings thereon providing close sliding fit of piston 16 within sleeve 17 which is, as previously stated in close fitting relationship with the inside of the tube comprising housing 11.

Figure 3:
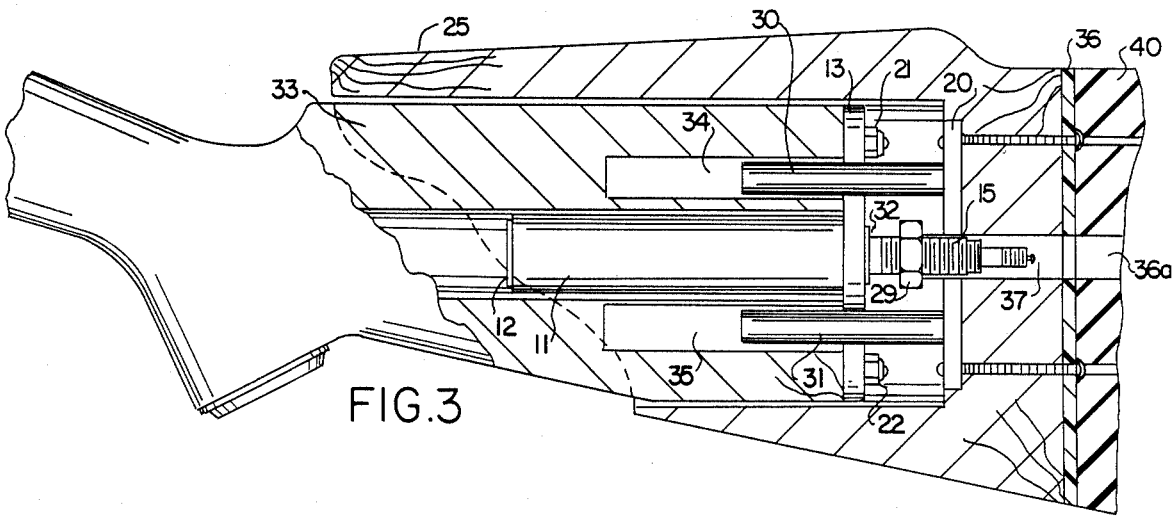
FIG. 3 is a view, partly in vertical section, of the device of FIG. 2, showing the device in place secured to the butt stock of a shot gun and to a boot which extends over and is in telescoping relationship with the butt end of a shotgun.

Secured to end plate 20 with screws 28 and 29 are guide rods 30 and 31 which are adapted to slidingly pass through the respective apertures in end plate 13, and into apertures 34 and 35 which have been bored into the butt end of stock 33, as shown in FIG. 3. Guide rods 30 and 31, which are more flexible than metal rods, are formed preferably of a plastic such as Delrin 500, an acetal resin manufactured by the DuPont Company, and have an extremely low coefficient of friction. These guide rods 30 and 31 and bushing 32 substantially eliminate binding of recoil reduction device 10 during recoil. This is of particular importance because binding would render the recoil reduction device 10 partially or completely ineffective for its intended function.

Referring to the embodiment of the invention shown in FIG. 3, housing member 11 is shown positioned within a cavity which has been bored in the stock 33. End plate 13, to which housing member 11 is rigidly secured, is connected to the butt end of stock 33 with screws 21 and 22 through holes 23 and 24. Boot 25 extends over and, as shown, is in telescoping relationship with the butt end of the stock 33 of a shotgun. End plate 20 is secured to the inside of the butt end of boot 25 with screws through holes 26 and 27 (FIG. 2), the heads of the screws being accessible through holes in the cushioned outer butt end 40 of boot 25, covering butt plate 36.

In putting the recoil reduction device 10 into operating condition, the space 38 between plug 12 and the end of piston 16 is filled with air through air valve 37, to any desired pressure. The end of valve 37 is positioned in recess 36a, and a dust cap (not shown) maintained thereover until air is to be added to or removed from the device 10. Thereupon the dust cap is removed and air is admitted, or removed, through the valve 37, from a source of air under pressure, such as is available at a service station, or the like. Of course an extension valve may be screwed into valve 37 if needed. The extension valve may then be removed after filling or adjusting of the air pressure, and aperture 36 in the butt of the boot re-covered with the dust cap. It is thus seen that the air pressure may be adjusted, as needed, without removing the boot 25, from the stock 33.

Adjustments in the length of the stock 33 are easily made in the field or at the shooting range with a crescent or other adjustable wrench and a screwdriver. The shooter removes the boot 25 from the stock 33, removes the guide rods 30 and 31, loosens the lock nut 29 with the crescent wrench, then turns end plate 20 and the lock nut 29 clockwise to shorten the stock 33, or counter-clockwise to lengthen the stock. The lock nut 29 is then retightened and the guide rods reinstalled.

Figure 4:
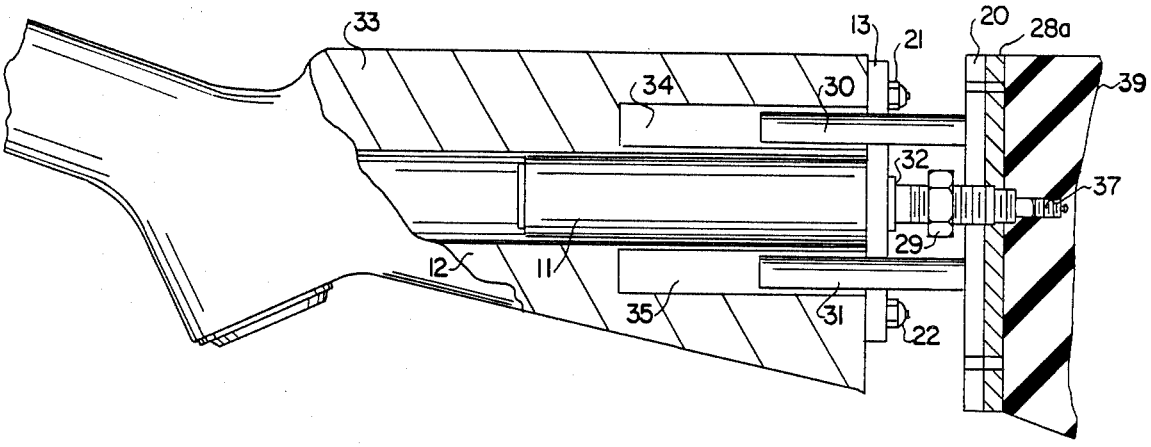
FIG. 4 is a view, partly in vertical section showing the device in place secured to the butt stock of a shotgun and to a butt plate and recoil pad.

In the embodiment of the invention shown in FIG. 4, there is no boot in telescoping relationship with the butt end of stock 33. As in the embodiment shown in FIG. 3, end plate 13, to which housing member 11 is rigidly secured, is connected to, the butt end of stock 33 with screws 21 and 22. End plate 20 is secured to a butt plate 28a by screws (not shown) and preferably has a recoil pad 39 suitably secured thereto. The recoil reduction device is placed in operating condition as previously described.

Adjustments in the length of the stock 33 are made as follows. The shooter removes end plate 20 from butt plate 28a, then removes guide rods 30 and 31, loosens lock nut 29, then, as previously described, turns end plate 20 and lock nut 29 clockwise to shorten, or counter clockwise to lengthen the overall length of the stock. Lock nut 29 is then retightened, the guide rods reinstalled, and end plate 20 again secured to butt plate 28a.

While the preferred embodiment of the device of our invention has been illustrated and described, it is to be appreciated that various changes and modifications may be made therein without departing from the scope of the invention, as defined by the appended claims.

We claim:

1. In combination with a shotgun of the type having a stock which contains a cavity opening into the butt end thereof to conformably receive and be rigidly securable to a recoil reduction means which is removably secured to a butt plate, the improvement wherein said recoil reduction means comprises:

(a) a housing including a cylinder, and having a first end plate secured to the butt end of said stock and apertured for slidably receiving therethrough a hollow piston rod and a plurality of guide rods;

(b) a second apertured end plate securable to an apertured butt plate;

(c) a piston in close sliding fit within said cylinder; and (d) a hollow piston rod, one end being connected to said piston, and the other end extending through said apertures in said plates and through said apertured butt plate, and terminating in a two-way valve for filling said cylinder with air from the rear of the stock without disconnecting said recoil reduction means from said stock and butt plate.

2. In combination with a shotgun of the type having a stock which contains a cavity opening into the butt end thereof to conformably receive and be rigidly securable to a recoil reduction means, and also having a boot inwardly fashioned to engage and partly telescope over said stock, said boot having an aperture therethrough at the butt end thereof, and having the recoil reduction means removably secured to both the butt end of said stock, and to the butt end of said boot, the improvement wherein said recoil reduction means comprises:

(a) a housing including a cylinder, and having a first end plate secured to the butt end of said stock and apertured for slidably receiving therethrough a hollow piston rod and a plurality of guide rods;

(b) a second apertured end plate securable to the butt end of said boot from outside the boot;

(c) a piston in close sliding fit within said cylinder; and (d) a hollow piston rod, one end being connected to said piston, and the other end extending through said apertures in said plates and through said apertured boot, and terminating in a two-way valve for filling said cylinder with air from the rear of the stock without disconnecting said recoil reduction means from said stock and boot.

3. The combination of claims 1 or 2 wherein said piston rod is threaded to receive a nut positionable thereon between said end-plates, and wherein the aperture in said second end-plate is threaded to receive said threaded piston rod, whereby movement of said second end plate on said piston rod results in a change in the distance between said end plates and concurrently results in a change in the overall length of the shotgun.

4. The combination of claim 3 wherein said second end plate has a plurality of guide rods secured thereto and the said first end-plate has at least a corresponding number of apertures therein for slidably receiving passage of said guide rods therethrough in a close fitting manner as the said piston rod moves in response to the firing of the shotgun, said guide rods being formed of a resin composition having a relatively low coefficient of friction.

5. The combination of claim 4 wherein said guide rods are cylindrical.

6. The combination of claims 1 or 2 wherein the piston rod-receiving aperture of said first end-plate is fitted with a bushing of a resin composition having a relatively low coefficient of friction.

7. The combination of claims 1 or 2 wherein the end of said housing opposite the first end plate contains a threadably secured fluid tight plug.

8. The combination of claim 2 wherein the end of said valve terminates within said boot.

9. A recoil reduction device for attachment to the stock of a shotgun said stock having a cavity of predetermined size and shape through the butt end thereof, and to a boot for said stock having a front end and a butt end and a cavity therein of a size and shape to conformably receive a portion of said stock, the butt end of said boot having an aperture therethrough into said boot cavity, said device comprising a housing including a cylinder and having an aperture-containing first end-plate securable to the butt end of said stock; a second aperture-containing end-plate securable to the butt end of said boot; a plurality cf guide rods secured to said second end-plate and slidably passable through apertures in said first end-plate; a piston in close sliding fit within said cylinder, said piston having a hollow rod portion extending through the said apertures in said end plates and terminating in a two-way valve for filling of said piston with air from the rear of said boot, without disconnecting the device from said stock and said boot.

10. A recoil reduction device for attachment to the stock of a shotgun, said stock having a cavity of predetermined size and shape through the butt end thereof and to an apertured butt plate, said device comprising a housing including a cylinder and having an aperture-containing first end-plate securable to the butt end of said stock; a second aperture-containing end-plate securable to said apertured butt plate, a plurality of guide rods secured to said second end-plate and slidably passable through apertures in said first end plate; a piston in close sliding fit within said cylinder, said piston having a hollow rod portion extending through said apertures in said end plates and terminating in a two way valve for filling of said piston with air from the rear of said butt plate.

11. The device of claims 9 or 10 wherein said rod portion is threaded to receive a nut positionable thereon between said end plates, and wherein the aperture in said second end plate is threaded to receive said threaded rod portion.

* * * * *